US008246329B2

(12) United States Patent
Li

(10) Patent No.: US 8,246,329 B2
(45) Date of Patent: Aug. 21, 2012

(54) FAN

(75) Inventor: Bing-Jian Li, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 216 days.

(21) Appl. No.: 12/779,929

(22) Filed: May 13, 2010

(65) Prior Publication Data

US 2011/0175493 A1 Jul. 21, 2011

(30) Foreign Application Priority Data

Jan. 20, 2010 (CN) ..... 2010 1 0300485

(51) Int. Cl.
*F04B 35/04* (2006.01)
*H02K 5/10* (2006.01)

(52) U.S. Cl. ..... 417/423.9; 310/63; 310/67 R; 310/88

(58) Field of Classification Search ..... 310/63, 310/67 R, 88, 156.26; 417/423.7, 423.14, 417/423.9; 360/99.08
See application file for complete search history.

(56) References Cited

U.S. PATENT DOCUMENTS

| | | | | |
|---|---|---|---|---|
| 5,744,881 | A * | 4/1998 | Ishizuka et al. | 310/67 R |
| 6,511,303 | B2 * | 1/2003 | Obara | 417/423.12 |
| 6,916,160 | B2 * | 7/2005 | Obara | 417/354 |
| RE39,117 | E * | 6/2006 | Matsumoto | 417/423.15 |
| 7,635,934 | B2 * | 12/2009 | Zhu et al. | 310/88 |
| 7,701,097 | B2 * | 4/2010 | Lan et al. | 310/61 |
| 8,067,870 | B2 * | 11/2011 | Kobayashi et al. | 310/156.05 |
| 2003/0068238 | A1 | 4/2003 | Hsieh | |
| 2008/0292479 | A1 * | 11/2008 | Lin et al. | 417/423.7 |

FOREIGN PATENT DOCUMENTS

| | | | |
|---|---|---|---|
| JP | 06292333 | A * | 10/1994 |
| JP | 2005-192363 | A | 7/2005 |

* cited by examiner

*Primary Examiner* — Burton Mullins
(74) *Attorney, Agent, or Firm* — Altis Law Group, Inc.

(57) ABSTRACT

A fan includes a bracket, a stator, a rotor, and a slanting portion. The bracket includes a tray, and a frame circling the tray. The stator is mounted to and circled by the frame. The rotor includes a shaft rotatably mounted to the stator, and a shell coupled to the shaft. The shell covers the stator, and the shell and the tray of the bracket cooperatively enclose the stator. An assembly clearance is formed between a bottom end of the shell and a top surface of the tray. The slanting portion circles the tray and extends down from the bottom end of the shell, slanting away and spaced from the tray.

4 Claims, 2 Drawing Sheets

FAN

CROSS-REFERENCE TO RELATED APPLICATION

The present application is related to a co-pending U.S. patent application, titled "FAN", with U.S. Ser. No. 12/779928, assigned to the same assignee as the present application, the disclosure of which is incorporated herein by reference.

BACKGROUND

1. Technical Field

The present disclosure relates to a fan.

2. Description of Related Art

When a fan operates, dust seems to inevitably penetrate the rotor of the fan through an assembly clearance that is formed during assembly of the fan and is between the rotor and a bracket for mounting the rotor and a stator. The dust can damage and shorten the service life of the fan.

In order to reduce damage caused by dust, anti-dust devices, such as dust rings, have been used for fans. An anti-dust device is often mounted between the bracket and the rotor to prevent dust from going through the assembly clearance. However, using anti-dust devices will increase the cost of fans.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

The disclosure comprising the accompanying drawings is illustrated by way of example and not by way of limitation, in which like references indicate similar elements. It should be noted that references to "an" or "one" embodiment in this disclosure are not necessarily to the same embodiment, and such references mean at least one.

Figure 1:
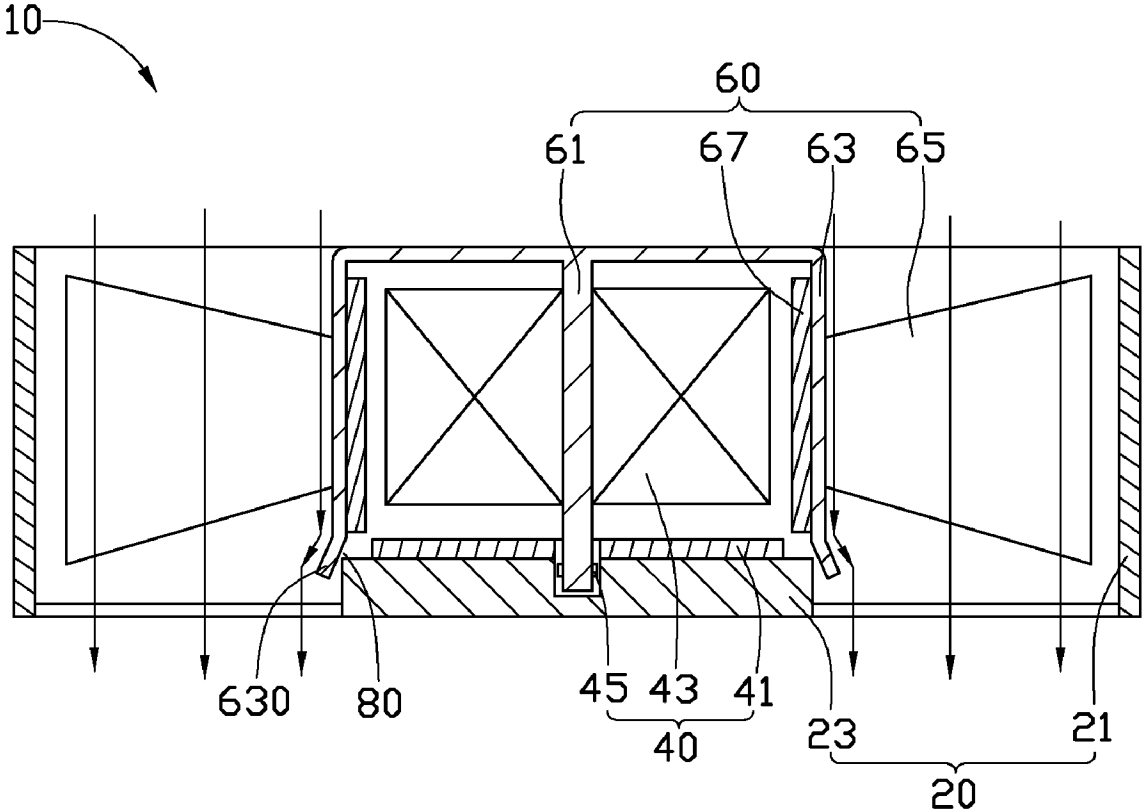
FIG. 1 is a sectional view of a first embodiment of a fan.

Referring to FIG. 1, in a first embodiment, a fan 10 includes a bracket 20, a stator 40, and a rotor 60. The stator 40 and the rotor 60 are mounted to the bracket 20.

The bracket 20 is a plastic part integrally formed. The bracket 20 includes a tray 23, and a frame 21 circling the tray 23.

The stator 40 is mounted to the tray 23 of the bracket 20 and circled by the frame 21 of the bracket 20. The stator 40 includes a circuit board 41 mounted on a top surface of the tray 23, a plurality of coils 43, and a ring 45. The circuit board 41 includes a control circuit for controlling rotation speed of the fan 10.

The rotor 60 includes a shaft 61, a shell 63, a plurality of blades 65, and a plurality of magnets 67. The shaft 61 is rotatably mounted to the ring 45 of the stator 40. The shell 63 is integrally formed together with the shaft 61. The shell 63 covers the stator 40. The shell 63 and the tray 23 of the bracket 20 cooperatively enclose the stator 40. An assembly clearance 80 is formed between a bottom end of the shell 63 and a top surface of the tray 23. The assembly clearance 80 is used to ensure that the shell 63 will not contact the tray 23 when the rotor 60 rotates. A slanting portion 630 that circles the tray 23 slantingly extends down from the bottom end of the shell 63 and passes the top surface of the tray 23. The slanting portion 630 opposes an outmost surface of the tray, and is spaced from the tray 23. The blades 65 extend from the shell 63, and are located between the shell 63 and the frame 21 of the bracket 20. The magnets 67 are attached to an inner surface of the shell 63, and are disposed around the coils 43 of the stator 40.

After research and testing, it is found that when a common fan operates, a part of the airflow caused by the fan will be rebounded by a tray of the fan to flow into a rotor of the fan, which is the main way that dust enters. When the fan 10 of the present disclosure operates, the slanting portion 630 will guide airflow away from the tray 23 preventing dust from entering the rotor 60.

Furthermore, an inclination of the slanting portion 630 should not be too large, to avoid blocking a part of the airflow. In some embodiments, the inclination of the slanting portion 630 may be 10~30 degrees.

Figure 2:
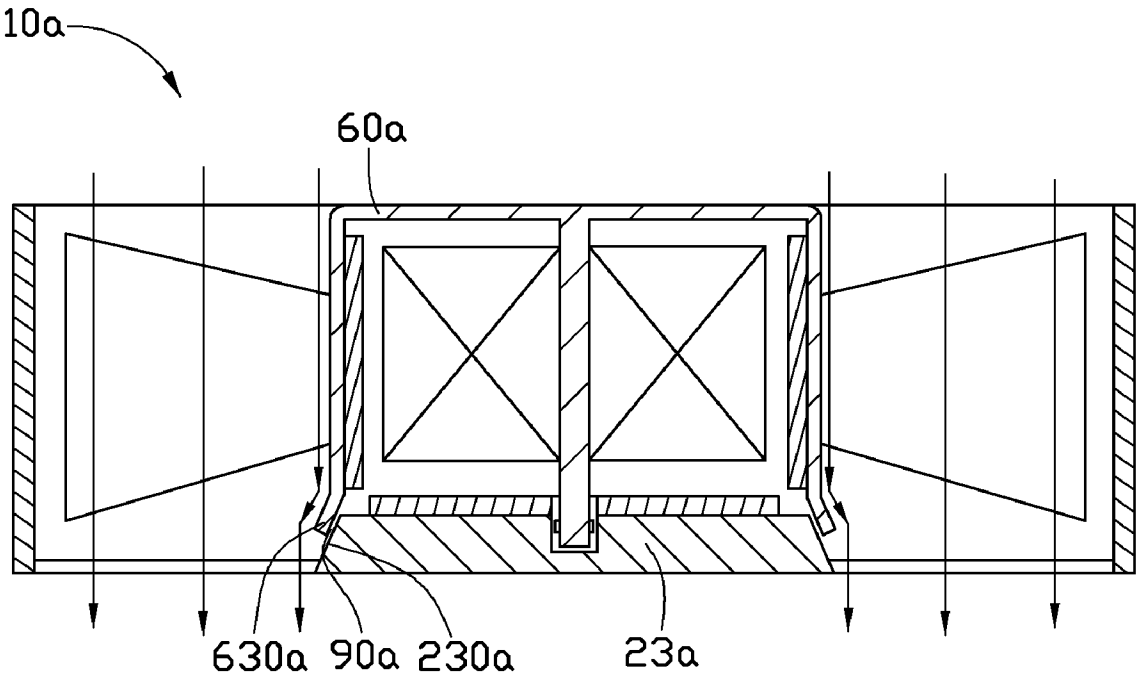
FIG. 2 is a sectional view of a second embodiment of a fan.

Referring to FIG. 2, a fan 10*a* in a second embodiment differs from the fan 10 in FIG. 1 in that a side surface of a tray 23*a*, facing a slanting portion 630*a* of a shell 60*a*, is a slanting surface 230*a*. The slanting surface 230*a* has a same inclination as the slanting portion 630*a*. The design of the slanting surface 230*a* can narrow a space 90*a* between the slanting portion 630*a* and the side surface of the tray 23*a*, to further lower a probability that dust enters a rotor 60*a*.

It is to be understood, however, that even though numerous characteristics and advantages of the disclosure have been set forth in the foregoing description, together with details of the structure and function of the disclosure, the disclosure is illustrative only, and changes may be made in detail, especially in matters of shape, size, and arrangement of parts within the principles of the disclose to the full extent indicated by the broad general meaning of the terms in which the appended claims are expressed.

What is claimed is:

1. A fan comprising:

a bracket comprising a tray, and a frame circling the tray;

a stator circled by the frame and comprising a circuit board mounted to a top surface of the tray;

a rotor comprising a shaft rotatably mounted to the stator, and a shell coupled to the shaft, wherein the shell covers the stator, an assembly clearance is formed between a bottom end of the shell and a top surface of the tray; and a slanting portion slantingly extending down from the bottom end of the shell, passing the top surface of the tray, facing an outmost surface of the tray, and spaced from the tray.

2. The fan of claim 1, wherein an inclination of the slanting portion is about 10~30 degrees.

3. The fan of claim 1, wherein a side surface of the tray, facing the slanting portion, is a slanting surface, and the slanting surface has a same inclination as the slanting portion.

4. The fan of claim 3, wherein the inclination of the slanting surface is about 10~30 degrees.

* * * * *